US009272407B2

(12) United States Patent
Fischer et al.

(10) Patent No.: US 9,272,407 B2
(45) Date of Patent: Mar. 1, 2016

(54) PERCUSSION TOOL HAVING COOLING OF EQUIPMENT COMPONENTS

(75) Inventors: Michael Fischer, Munich (DE); Otto W. Stenzel, Herrsching (DE); Wolfgang Hausler, Munich (DE); Rudolf Berger, Grünwald (DE); Christian Littek, Karlsfeld (DE); Helmut Braun, Bergkirchen (DE); Manfred Zinsmeister, Fürstenfeldbruck (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 757 days.

(21) Appl. No.: 13/521,077

(22) PCT Filed: Jan. 13, 2011

(86) PCT No.: PCT/EP2011/000134
§ 371 (c)(1),
(2), (4) Date: Jul. 9, 2012

(87) PCT Pub. No.: WO2011/085989
PCT Pub. Date: Jul. 21, 2011

(65) Prior Publication Data

US 2013/0098650 A1 Apr. 25, 2013

(30) Foreign Application Priority Data

Jan. 15, 2010 (DE) ..... 10 2010 004 724

(51) Int. Cl.
*B25D 17/20* (2006.01)
*B25D 9/10* (2006.01)

(52) U.S. Cl.
CPC *B25D 17/20* (2013.01); *B25D 9/10* (2013.01); *B25D 2211/068* (2013.01); *B25D 2217/0061* (2013.01)

(58) Field of Classification Search
CPC ..... B25D 9/10; B25D 17/20; E21C 3/18; F01P 1/06; F01P 1/02; F01P 5/06; F01P 1/065; F01P 5/02
USPC ..... 173/209, 90, 105, 114, 132, 201, 210, 173/211; 123/41.65, 41.67, 41.68, 41.49
See application file for complete search history.

(56) References Cited

U.S. PATENT DOCUMENTS 2,764,138 A 9/1956 Wahlsten et al.
2,857,888 A 10/1958 Guthrie (Continued)

FOREIGN PATENT DOCUMENTS

CA 1118689 A1 * 2/1982 ..... B25D 11/125
DE 866 633 C 2/1953

(Continued)

OTHER PUBLICATIONS

International Search Report for PCT/EP2011/000134, Dated Mar. 30, 2011.

*Primary Examiner* — Gloria R Weeks
*Assistant Examiner* — Chinyere Rushing-Tucker
(74) *Attorney, Agent, or Firm* — Boyle Fredrickson, S.C.

(57) ABSTRACT

A percussion tool has a cooling air channel for guiding a cooling air flow from a cooling air fan to an outside wall of a cylinder of an internal combustion engine. The cooling air channel is tapered to the extent that partial cooling air flows guided between the respective cooling fins are branched off the main cooling air flow. In such a way, the flow rate of the cooling air flow in the cooling air channel remains substantially constant, resulting in optimized engine cooling. The cooling air channel may be divided into two cooling air channels downstream of the cylinder. One of the cooling air channels guides cooling air to an exhaust gas system of the internal combustion engine, while the other cooling air channel guides cooling air to an outside wall of the guide housing of a hammer mechanism.

12 Claims, 4 Drawing Sheets

(56) References Cited

U.S. PATENT DOCUMENTS

| | | | | |
|---|---|---|---|---|
| 3,718,193 | A * | 2/1973 | Wanner | B25D 11/125 173/117 |
| 4,094,365 | A * | 6/1978 | Wanner | 173/117 |
| 6,325,157 | B1 * | 12/2001 | Arakawa et al. | 173/201 |
| 2006/0131042 | A1 * | 6/2006 | Hammerstingl et al. | 173/201 |
| 2008/0314608 | A1 * | 12/2008 | Berger et al. | 173/132 |

FOREIGN PATENT DOCUMENTS

| | | | |
|---|---|---|---|
| GB | 2 027 62 9 | A | 8/1978 |
| JP | 48111601 | U | 12/1973 |

* cited by examiner

PERCUSSION TOOL HAVING COOLING OF EQUIPMENT COMPONENTS

BACKGROUND OF THE INVENTION

1. Field of the Invention

The invention relates to a percussion tool having a combustion engine.

2. Discussion of the Related Art

Percussion tools such as hammer drills and/or percussion hammer drills having a combustion engine—hereinafter referred to in short as hammer drills—are known in particular as relatively heavy breakers, which are essentially worked vertically in a downward direction. In petrol-powered hammer drills of this kind, a cooling air fan driven via the crankshaft of the combustion engine is provided for cooling the engine. The cooling air fan produces a cooling air flow which is conducted along the outside of the combustion engine cylinder, particularly along the cooling fins provided on the outside of the cylinder. The engine cooling exhaust air discharged from the engine is usually very hot in this case and must therefore be conducted away from the hammer drill by the shortest route.

The percussion mechanism driven by the combustion engine provided to generate the working movement of the hammer drill may also heat up intensely due to the air compression, particularly when a pneumatic percussion mechanism is involved. In order to cool the percussion mechanism, it is therefore known for an additional fan wheel to be provided, which produces a separate flow of cooling air for the percussion mechanism. The appropriate space must be provided for installing this additional fan wheel and design work undertaken.

A rock drill in which a cooling air flow is produced by a cooling air fan is known from DE 866 633 C. The cooling air flow is conducted over ribs to the outer wall of an engine cylinder after which it emerges on the underside of the hood forming the cooling air duct. The problem addressed by the invention is that of specifying a hammer drill and/or percussion hammer drill, in which improved cooling of the components is possible.

SUMMARY OF THE INVENTION

The problem is solved according to the invention by providing a percussion tool as will now be described.

A percussion tool has a combustion engine with a cylinder and a piston movable in the cylinder, a cooling air fan to produce a cooling air flow and a cooling air duct to conduct the cooling air flow from the cooling air fan to an outer wall of the cylinder. Downstream of the outer wall of the cylinder, the cooling air duct has a duct section in which a plurality of partial cooling air flows are diverted from the cooling air flow (main cooling air flow).

The duct section is designed such that the cross-section of said duct section is tapered relative to one flow direction of the cooling air flow to the extent that partial cooling air flows are diverted from the cooling air flow, so that the flow rate of the cooling air flow in the duct section remains essentially constant.

While the cooling air duct is intended to define the entire length of the cooling air flow from the cooling air fan to the outlet from the hammer drill, the duct section only indicates a partial section of the cooling air duct. However, the duct section is of particular importance for the following observation.

Consequently, the cooling air duct in the section in which cooling of the cylinder or outer wall of the cylinder is to take place is designed such that the flow rate of the cooling air flow (main cooling air flow) remains constant, even when partial cooling air flows have already been diverted. In the state of the art, on the other hand, the cross section of the duct section remains essentially constant, so that the flow rate of the cooling air is gradually reduced if partial cooling air flows are diverted. However, the fact that the flow rate and therefore the volume flow of cooling air thereby becomes smaller over the course of the cooling air duct means that a relatively strong cooling air flow must be generated by the cooling air fan at the input end in the state of the art, so that there is still sufficient cooling air available at the end of the cooling air duct once a plurality of partial cooling air flows have been diverted.

It is therefore possible with the help of the invention for the flow to be conducted optimally in the hot cylinder section by tapering the cooling air duct upstream of the cylinder, so that, for example, even in the section which lies further away from the spark plug provided at the cylinder and is therefore cooler, a lot of cooling air flows past. A separate by-pass, which would have a similar effect, can therefore be dispensed with. This leads to reduced heating of the engine cooling exhaust air and also to a lower flow resistance.

The engine cooling air may be blown through the engine with comparatively lower flow resistance. The volume flow is thereby increased and the cooling air temperature reduced. The engine only emits the amount of heat necessary for it into the cooling air, which means that the cooling air is not as intensely heated either. By contrast, a cooling air distribution is usually sought after in the state of the art, in which the greatest possible amount of heat is removed from the engine, even though this is often unnecessary.

A plurality of cooling ribs running parallel to one another may be formed on the outer wall of the cylinder, wherein a partial duct is formed between each two cooling ribs disposed adjacent to one another, in order to conduct a partial cooling air flow, wherein the partial cooling air flow is diverted from the cooling air flow introduced by the cooling air fan. The cooling ribs are provided on the outer wall of the cylinder in a known fashion and usually cast integrally with the cylinder housing or subsequently attached to the outer wall of the cylinder as cooling elements. One of the partial ducts is formed between each of the adjacent cooling ribs, into which a partial cooling air flow is introduced in each case. The partial cooling air flows in each case are gradually diverted from the main cooling air flow, when the main cooling air flow is conducted past the cooling ribs of the cylinder.

In particular, the duct section may be conducted upstream of the cooling ribs past the cooling ribs and therefore past the partial ducts or the initial sections of the partial ducts. In this case the duct section may be designed such that the cross section of the duct section is tapered over its course along the initial sections of the respective partial ducts, to such an extent that partial cooling air flows are diverted from the cooling air flow, so that the above requirement that the flow rate of the cooling air flow in the duct section remains essentially constant is met.

The flow rates of the partial cooling air flows in the partial ducts may be essentially identical. They may, in particular, also be identical to the flow rate of the remaining cooling air flow in the duct section. In this way, a steady, optimized cooling air flow with the smallest possible flow resistance is achieved. An indication of an unnecessary flow resistance would be, for example, a significant change in the flow rate in the cooling air duct.

In one variant, the cooling air flow is conducted in a particularly advantageous manner. It can also be ensured in this case that the percussion mechanism driven by the combustion engine of the hammer drill is cooled.

In this variant, a cooling air duct for conducting the cooling air flow from the cooling air fan along an outer wall of the cylinder is provided, whereby the cooling air duct has a duct section downstream of the outer wall of the cylinder for conducting the cooling air flow to an exhaust system of the combustion engine and/or to the percussion mechanism.

It is thereby possible to ensure that the cooling air, which has already heated up while flowing past the cylinder, can be further used to cool other hot components, the temperature of which lies above the temperature of the flow of cooling air downstream of the cylinder during operation. These components include, in particular, the exhaust system of the combustion engine or percussion mechanism.

In this solution the engine cooling exhaust air is thereby used to cool other hammer drill components, namely the exhaust system, in particular, e.g. the sound damper, and the percussion mechanism. The exhaust system and the percussion mechanism are subject to a high thermal load during the hammer drill operation. The waste heat from these may on the one hand be problematic for the components themselves. On the other hand, though, the waste heat may also cause excessive heating of other components of the hammer drill, e.g. the carburetor or fuel pump, which can impede reliable operation.

It has emerged that the cooling air (engine cooling exhaust air) coming from the engine, in other words, from the outer wall of the cylinder, is still comparatively cool and can therefore be used for cooling further components. Consequently, in one variant, for example, this engine cooling exhaust air flow can be divided downstream of the outer wall of the cylinder and supplied in the form of two separate cooling air flows to the exhaust system and the percussion mechanism.

Through skillful design of the cooling air duct, it is therefore possible to conduct a cooling air flow suitable for the device concerned. Consequently, downstream of the cylinder, the cooling air flow, for example, may either only be conducted to the exhaust system or only to the percussion mechanism or also to both assemblies. Furthermore, it is possible to conduct the cooling air flow first to the percussion mechanism, for example, and then downstream of the percussion mechanism to the exhaust system. Likewise, in converse fashion, the cooling air flow may also be conducted firstly to the exhaust system and then to the percussion mechanism. The cooling air flow may also be divided into two parallel cooling air flows, which flow parallel to the exhaust system and the percussion mechanism.

Mixed forms are also possible, e.g. the cooling air flow is divided into two cooling air flows downstream of the outer wall of the cylinder, in which case one cooling air flow is conducted straight to the exhaust system and a second cooling air flow first to the percussion mechanism and only then to the exhaust system.

The exact embodiment of the cooling air duct and therefore of the conducting of the cooling air flow depends on the temperature distributions in the hammer drill and on the desired cooling effect.

In one embodiment, the cooling air duct exhibits a first duct section downstream of the outer wall of the cylinder, for conducting the cooling air flow to the percussion mechanism. Downstream of the percussion mechanism, the cooling air duct exhibits a second duct section for conducting the cooling air flow to the exhaust system. In this way, the cooling air flow is conducted in series, first to the percussion mechanism and then to the exhaust system.

In a further embodiment the cooling air duct is divided downstream of the outer wall of the cylinder into a first cooling air duct for a first cooling air flow and into a second cooling air duct for a second cooling air flow. The first cooling air duct is used for conducting the first cooling air flow to an exhaust system of the combustion engine, while the second cooling air duct is used to conduct the second cooling air flow to the percussion mechanism.

The percussion mechanism may be a pneumatic percussion mechanism and exhibit a guide housing and also a drive piston movable by the combustion engine in the guide housing, e.g. in an oscillating and linear manner, wherein the second cooling air duct is used to conduct the second cooling air flow to an outer side of the guide housing. Correspondingly, the first duct section may also be designed to conduct the cooling air flow to the outer side of the guide housing. The heat in the percussion mechanism is generated particularly proximate to the air compression section within the percussion mechanism, when the percussion mechanism is a pneumatic percussion mechanism known per se. This heat is emitted outwardly via the guide housing and can be removed by the cooling air flow. Since the temperature occurring in the percussion mechanism is greater than the temperature of the engine cooling exhaust air, the engine cooling exhaust air can still be effectively used to cool the percussion mechanism.

In one variant, the second cooling air duct may be designed such that the second cooling air flow downstream of the percussion mechanism can still be conducted to the exhaust system of the combustion engine. It has therefore emerged that the cooling air still exhibits a temperature lower than the exhaust temperature of the combustion engine, particularly lower than the temperature of the sound damper belonging to the exhaust system, even when it has already cooled the engine (cylinder) and the percussion mechanism. For this reason, it may be advantageous for the cooling air still to be used to support cooling of the sound damper, after cooling of the percussion mechanism, so that the cooling effect is thereby improved.

The variants described above may be combined with one another in any way. It is therefore possible to divide the cooling air flow independently into a first cooling air flow and a second cooling air flow downstream of the outer wall of the cylinder. Likewise, it is possible to design the cooling air duct in the duct section disposed upstream of the outer wall of the cylinder in the manner described, so that the flow rate of the cooling air flow remains essentially constant in this duct section. Likewise, however, the two variants may also be combined with one another, in order to achieve particularly effective cooling.

This and other advantages and features of the invention are explained in greater detail below using an example with the help of the accompanying figures.

BRIEF DESCRIPTION OF THE DRAWINGS

In the figures:

FIGS. 1 to 4 show a schematic example of a hammer drill and/or percussion hammer drill according to the invention in different representations.

DETAILED DESCRIPTION OF THE PREFERRED EMBODIMENT

Figure 1:
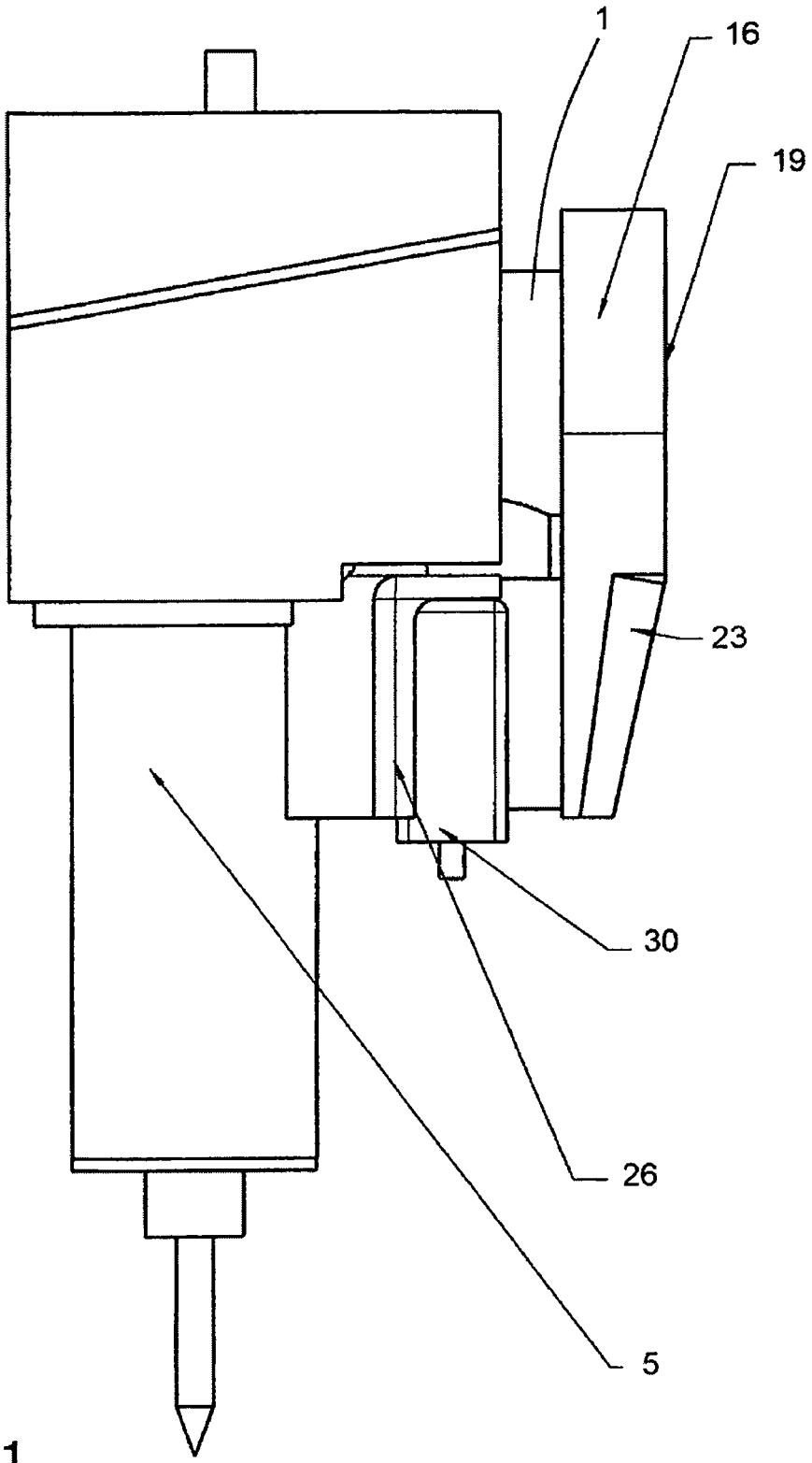
FIG. 1 shows a right side view of a hammer drill.
Figure 2:
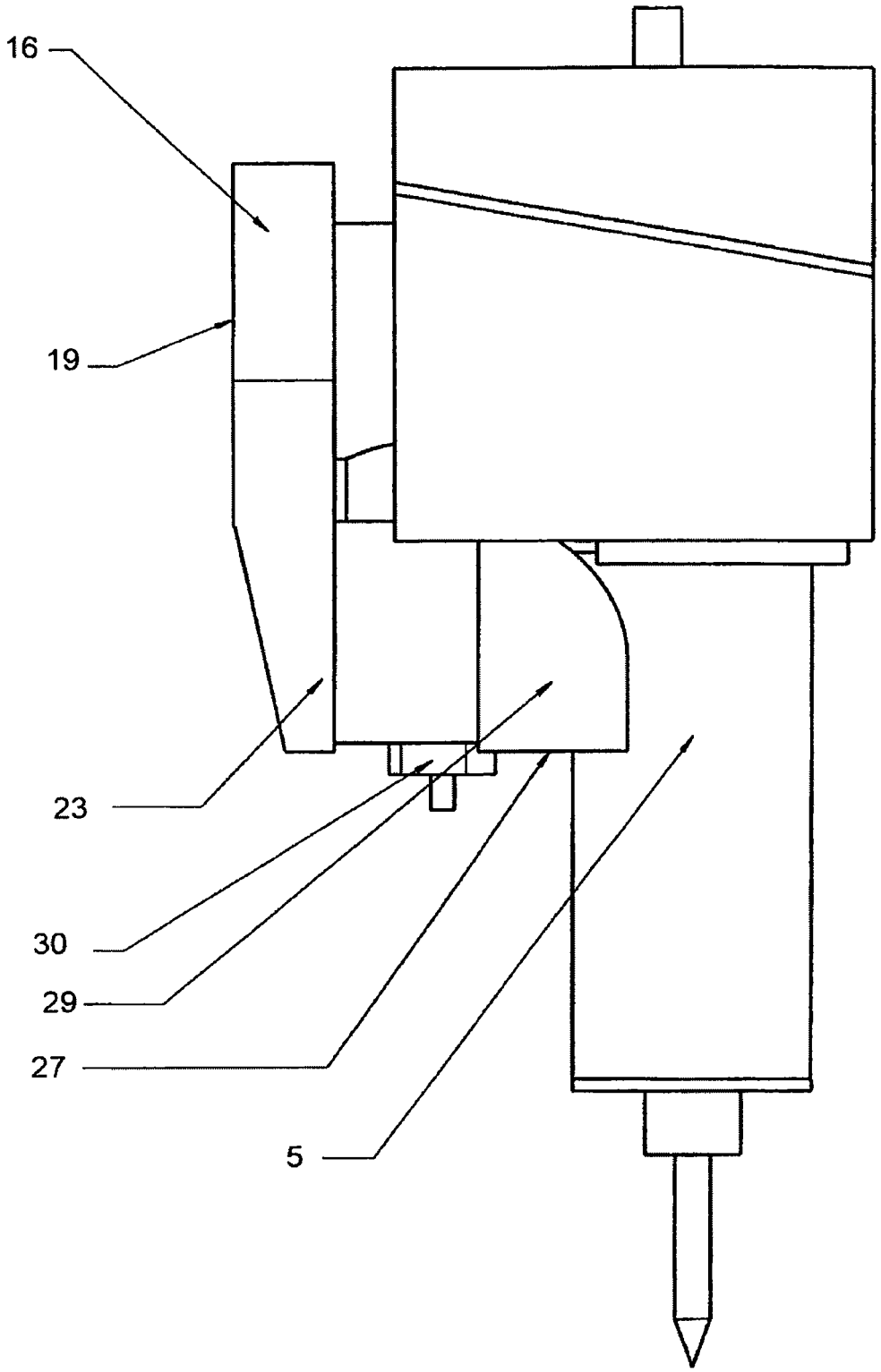
FIG. 2 shows a left side view of the hammer drill in FIG. 1.

The hammer drill has a combustion engine 1, which drives a percussion mechanism 5 via a first crank mechanism 2, a gear 3 and a second crank mechanism 4. The percussion mechanism 5 in turn strikes a tool 6, in the present case a bit. The design of a hammer drill of this kind is widely known and need not therefore be explained in detail.

The combustion engine 1 has a cylinder 7, within which a piston 8 is movably conducted. The piston 8 drives the first crank mechanism 2 via a connecting rod 9.

The gear 3 and therefore the second crank mechanism 4 are moved via a crankshaft 10 of the crank mechanism 2.

The percussion mechanism 5 is in the form of a pneumatic percussion mechanism and has a connecting rod 11 moved by the second crank mechanism 4, which moves a drive piston 12 back and forth in a guide housing 13 belonging to the percussion mechanism.

A main piston 14 is conducted within the drive piston 12, said main piston moving towards the end of the tool 6 and back again via a pneumatic spring 15 formed between the drive piston 12 and the main piston 14. The function of a percussion mechanism 5 of this kind is also known and need not be dealt with in greater detail here.

A cooling air fan 16 with a fan wheel 17, a fan housing 18 and a cooling air intake 19 is disposed at the front end of the crankshaft 10. The fan wheel 17 is driven rotationally by the crankshaft 10 and thereby draws in ambient air through the cooling air intake 19. The cooling air is then conducted through a cooling air duct 20 to the hammer drill components to be cooled.

In particular, the cooling air duct 20 conducts the cooling air to an outer wall of the cylinder 7, on which a plurality of cooling ribs 21 are disposed in the known manner. In the interests of clarity, only two of the cooling ribs 21 with the reference number 21 are marked in FIG. 3. It goes without saying that the outer wall of the cylinder 7 has a plurality of cooling ribs 21, as is also immediately evident from FIG. 3.

Partial ducts 22 are formed between each of the cooling ribs 21, in which the air flow can be conducted from the cooling air duct 20 past the outer wall of the cylinder 7. Each of these partial ducts 22 thereby diverts a partial cooling air flow from the main cooling air flow in the duct section of the cooling air duct 20 lying upstream of the cylinder 7.

Figure 3:
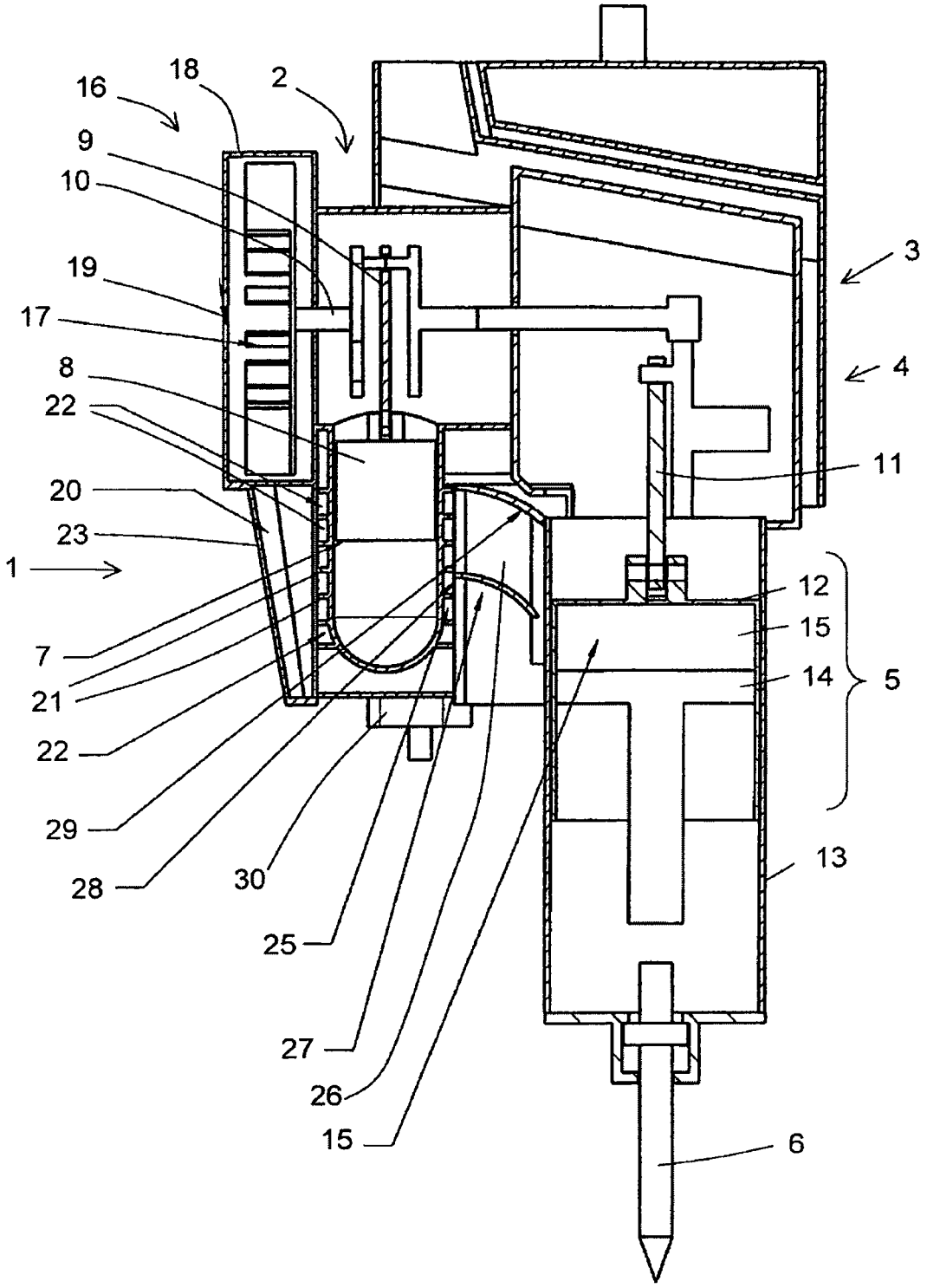
FIG. 3 shows a sectional representation of the hammer drill.

As can be seen in FIG. 3, the cooling air flow flows from above in the cooling air duct 20, i.e. coming downwards from the cooling air fan 16, wherein in the aforementioned duct section partial cooling air flows are gradually diverted via partial ducts 22 in each case and conducted past the outer wall of the cylinder 7. The cooling air duct 20 is thereby tapered to the extent that cooling air is diverted by it into the respective partial duct 22. The cross section of the cooling air duct 20 should thereby be reduced, such that the flow rate of the cooling air flow in the cooling air duct 20 provided upstream of the cylinder 7 remains constant. This tapering can be recognized in FIG. 3 from an obliquely extending duct cover 23.

Figure 4:
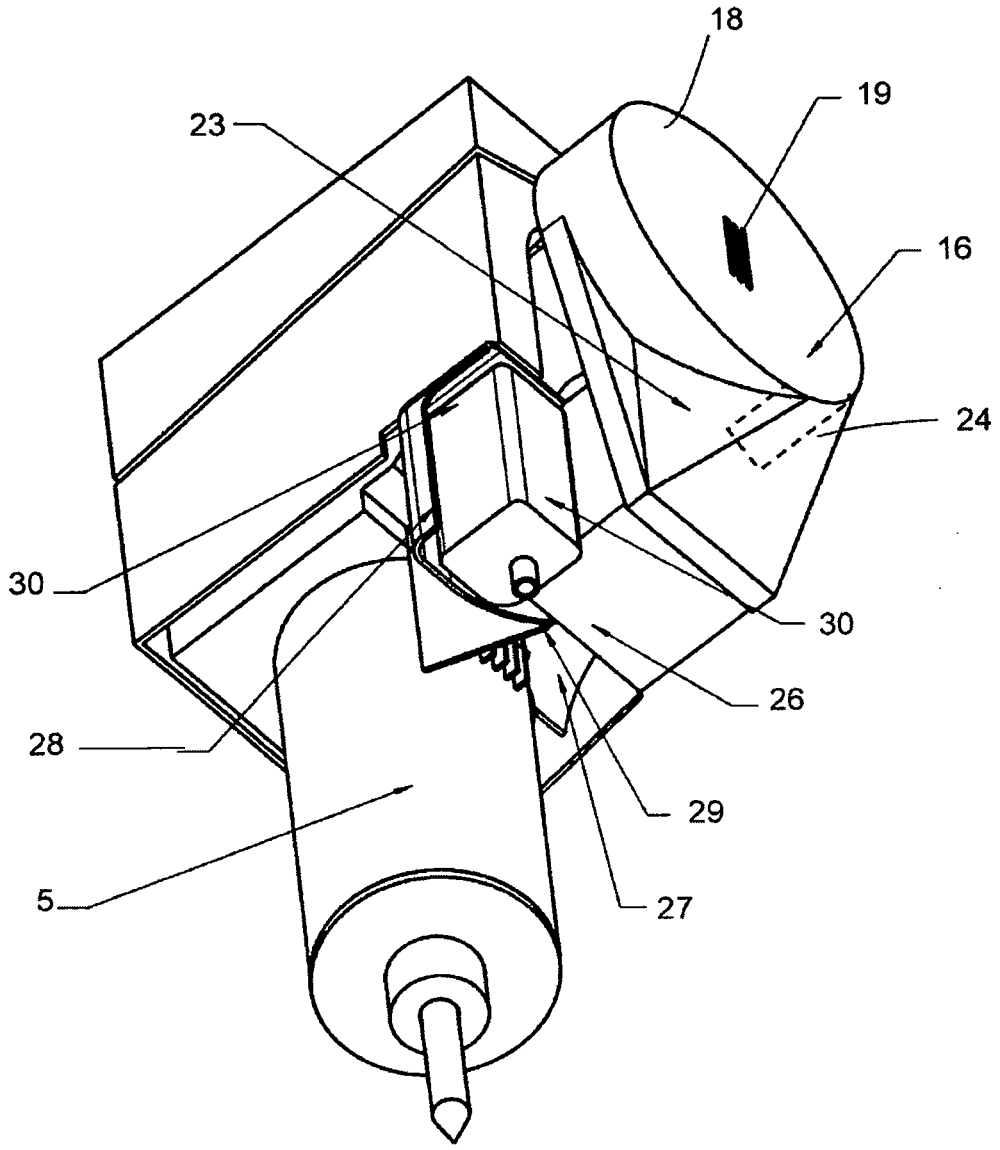
FIG. 4 shows a perspective underside view of the hammer drill.

The cross-sectional tapering of the cooling air duct can be seen even more clearly in FIG. 4, where the duct cover 23 starting at a duct inlet 24—based on an operating setting of the hammer drill with a vertically downward working direction—extends obliquely both downwards vertically and also horizontally away from the duct inlet 24 and thereby tapers the cooling air duct 20. The duct inlet 24 is only shown in FIG. 4 by means of dotted lines, as it is not of course outwardly visible under the duct cover 23.

The cooling air flow thereby created in the cooling air duct 20 and in the various partial ducts 22 largely exhibits a constant, uniform flow rate, which is favorable to optimized engine cooling.

The cooling air may be discharged into the environment downstream of the combustion engine 1, in other words downstream of the outer wall of the cylinder 7.

However, in a particularly advantageous embodiment of the invention—as is also shown in the figures—the cooling air coming from the engine is further used to cool components heated during the hammer drill operation. In particular, the cooling air duct 20 at one outlet 25, at which the cooling air is conducted away from the cooling ribs 21 and the outer wall of the cylinder 7, is divided into a first cooling air duct 26 and a second cooling air duct 27. The division is performed with the help of baffle plates 28 and 29. The baffle plates 28, 29 may be suitably formed in the space, in order to conduct the respective cooling air flows to the sections to be cooled.

A first cooling air flow is conducted into the first cooling air duct 26 and conducted to an exhaust system 30 of the combustion engine 1, particularly to a sound damper.

The exhaust system 30 with the sound damper becomes particularly hot during the hammer drill operation, so that the cooling air coming from the engine can still help to cool the exhaust system 30, even though said cooling air is already heated. It is thereby also particularly ensured that the exhaust system 30 cannot for its part heat other components of the hammer drill, such as the fuel supply, the tank or the carburetor, for example, in an unacceptable manner during prolonged use of the hammer drill.

The second cooling air duct 27 conducts the second cooling air flow as cooling air to the percussion mechanism 5, particularly to the outer wall of the guide housing 13 of the percussion mechanism 5, and from there to a section of the percussion mechanism 5, in which compression of the pneumatic spring 15 takes place. Through compression of the pneumatic spring 15, intense heating is caused in the percussion mechanism 5. This heat may be discharged by the second cooling air flow supplied in the second cooling air duct 27.

Moreover, if the hammer drill is suitably designed, it is possible for the second cooling air flow also to be further supplied to the exhaust system 30 after it has flowed past the percussion mechanism 5, so that the second cooling air flow, which has only been comparatively slightly heated in addition by the percussion mechanism 5, can still also be used to cool the hot sound damper in the exhaust system 30.

By optimizing the engine air cooling in the manner described above by creating a steady flow rate, it is possible for the temperature of the engine cooling exhaust air to be lowered to such an extent that it can be used to cool further components of the hammer drill.

Through targeted guidance and distribution of the engine cooling exhaust air it is possible to ensure that said cooling exhaust air is only supplied to sections whose temperature is so high that they can still be cooled, despite the already relatively warm engine cooling exhaust air. For example, motor cooling exhaust air at a temperature of 80° C. can still easily cool down a sound damper with a temperature of 300° C.

The fact that after passing the outer wall of the cylinder 7 the engine cooling exhaust air is conducted straight to the other hot heat sources of the hammer drill, where it has a cooling effect, means that sections of the hammer drill whose temperature lies below that of the engine cooling exhaust air are also further cooled indirectly. This is achieved in that less heat is conducted into surrounding components or assemblies proximate to the heat source, so that said components or assemblies likewise remain cooler.

As described in detail in the introduction to the description, it is also possible to configure the cooling air duct such that the cooling air is first conducted to the outer wall of the guide housing 13 and then along the exhaust system 30 after flowing past the cylinder 7. Likewise, the cooling air may also be conducted exclusively to the exhaust system 30.

The invention claimed is:

1. A percussion tool comprising:

a combustion engine with a cylinder and a piston movable in the cylinder;

a cooling air fan to produce a cooling air flow;

a cooling air duct to conduct the cooling air flow from the cooling air fan to an outer wall of the cylinder;

wherein upstream of the outer wall of the cylinder, the cooling air duct has an upstream duct section and plurality of partial ducts into which a plurality of partial cooling air flows are diverted from the cooling air flow in the upstream duct section; and wherein the cross-section of said upper duct section is inwardly tapered relative to a flow direction of the cooling air flow therethrough to cause the flow rate of the cooling air flow to remain constant through the entire cooling air duct.

2. The percussion tool as claimed in claim 1, wherein a plurality of cooling ribs running parallel to one another are formed on the outer wall of the cylinder; and wherein a partial duct is formed between each set of two cooling ribs that are disposed adjacent to one another, in order to conduct a partial cooling air flow, wherein the partial cooling air flow is diverted from the cooling air flow introduced by the cooling air fan.

3. The percussion tool as claimed in claim 2, wherein the duct section passes the cooling ribs and, therefore, the partial ducts upstream of the cooling ribs and is designed such that the cross-section of the duct section is tapered along the initial sections of the respective partial ducts, to such an extent that partial cooling air flows are diverted from the cooling air flow, so that the cooling air flow in the duct section remains constant.

4. The percussion tool as claimed in claim 2, wherein the flow rates of the partial cooling air flows in the partial ducts are identical.

5. The percussion tool as claimed in claim 1, wherein the cooling air fan is driven via a crankshaft of the combustion engine.

6. A percussion tool comprising:

a combustion engine with a cylinder and a piston movable in the cylinder;

a percussion mechanism driven by the combustion engine;

a cooling air fan to produce a cooling air flow; and a cooling air duct configured to conduct the cooling air flow from the cooling air fan along an outer wall of the cylinder, wherein the cooling air duct has an upstream section, upstream of the outer walls of the cylinder, and a plurality of partial ducts, the upstream section inwardly tapered such that the flow rate of the cooling air is maintained, at a constant flow rate through the entire cooling air duct;

wherein the cooling air duct has a first duct section downstream of the outer wall of the cylinder for conducting the cooling air flow to the percussion mechanism.

7. The percussion tool as claimed in claim 6, wherein the cooling air duct downstream of the outer wall of the cylinder exhibits the first duct section for conducting the cooling air flow to the percussion mechanism; and that the cooling air duct downstream of the percussion mechanism exhibits a second duct section for conducting the cooling air flow to the exhaust system of the internal combustion engine.

8. The percussion tool as claimed in claim 6, wherein the cooling air duct is divided downstream of the outer wall of the cylinder into a first cooling air duct for a first cooling air flow and into a second cooling air duct for a second cooling air flow; the first cooling air duct is used for conducting the first cooling air flow to the exhaust system of the combustion engine; and the second cooling air duct is used to conduct the second cooling air flow to the percussion mechanism.

9. The percussion tool as claimed in claim 8, wherein the percussion mechanism has a guide housing and a drive piston movable by the combustion engine in the guide housing; and wherein the second cooling air duct is used to conduct the second cooling air flow to an outer side of the guide housing.

10. The percussion tool as claimed in claim 8, wherein the second cooling air duct is configured such that the second cooling air flow downstream of the percussion mechanism can be conducted to the exhaust system of the combustion engine.

11. The hammer drill and/or percussion drill as claimed in claim 1, further comprising a percussion mechanism driven by the combustion engine.

12. A percussion tool comprising:

a combustion engine with a cylinder and a piston movable in the cylinder;

a percussion mechanism: driven by the combustion engine;

a cooling air fan to produce a cooling air flow;

a cooling air duct to conduct the cooling air flow from the cooling air fan to an outer wall of the cylinder;

wherein, the cooling air duct has an upstream duct section, upstream of the outer walls of the cylinder, and a plurality of partial ducts into which a plurality of partial cooling air flows are diverted from the cooling air flow in the upstream duct section of the cooling duct;

wherein the upstream duct section of the cooling duct is inwardly tapered relative to a flow direction of the cooling air flow therethrough to cause the flow rate of the cooling air flow to remain constant through the entire cooling air duct, the cooling air duct has a downstream duct section downstream of the outer wall of the cylinder for conducting the cooling air flow to the percussion mechanism.

* * * * *